US009451820B2

(12) United States Patent
Lukin

(10) Patent No.: US 9,451,820 B2
(45) Date of Patent: Sep. 27, 2016

(54) ATTACHMENT TO A MECHANIC'S TOOLBELT

(71) Applicant: Ivan Dean Lukin, Port Lions, AK (US)

(72) Inventor: Ivan Dean Lukin, Port Lions, AK (US)

( * ) Notice: Subject to any disclaimer, the term of this patent is extended or adjusted under 35 U.S.C. 154(b) by 0 days.

(21) Appl. No.: 14/320,944

(22) Filed: Jul. 1, 2014

(65) Prior Publication Data

US 2016/0001938 A1 Jan. 7, 2016

(51) Int. Cl.

| | |
|---|---|
| ***B65D 51/00*** | (2006.01) |
| ***A45F 5/02*** | (2006.01) |
| ***B25H 3/00*** | (2006.01) |
| ***B65D 47/06*** | (2006.01) |
| ***B25C 3/00*** | (2006.01) |
| ***A45C 13/02*** | (2006.01) |

(52) U.S. Cl.

CPC ..... *A45F 5/021* (2013.01); *A45C 13/02* (2013.01); *B25C 3/00* (2013.01); *B25C 3/002* (2013.01); *B25H 3/00* (2013.01); *B65D 47/06* (2013.01); *B65D 51/00* (2013.01); *A45F 5/022* (2013.01); *A45F 2200/0575* (2013.01)

(58) Field of Classification Search

CPC ..... A45C 11/24; A45C 13/02; A45F 2200/0575; A45F 2200/05; A45F 5/022; B65D 33/24; B65D 33/243; B65D 47/2031; B25H 3/00; B25H 3/02

USPC ..... 221/154, 267, 306, 307, 309, 33, 63; 224/240

See application file for complete search history.

(56) References Cited

U.S. PATENT DOCUMENTS

| | | | | |
|---|---|---|---|---|
| 4,884,717 | A * | 12/1989 | Bussard | B65D 47/06 220/229 |
| 5,201,869 | A * | 4/1993 | Roethel | A47F 1/085 221/304 |
| 7,353,968 | B2 * | 4/2008 | Cotsalas | A47F 1/06 206/229 |
| 7,591,388 | B2 * | 9/2009 | Amormino | B65D 47/06 220/229 |
| 7,721,885 | B2 * | 5/2010 | Conklin | B25H 3/00 206/338 |
| 8,302,798 | B2 * | 11/2012 | Moss | B65D 43/0212 220/229 |
| 8,453,864 | B2 * | 6/2013 | Krueger | B65D 51/00 220/229 |
| 2009/0057329 | A1 * | 3/2009 | Clough | B65D 83/0805 221/33 |
| 2012/0170873 | A1 * | 7/2012 | Mathews | B65D 33/24 383/33 |

* cited by examiner

*Primary Examiner* — Anthony Stashick
*Assistant Examiner* — Mollie Llewellyn
(74) *Attorney, Agent, or Firm* — Davis Wright Tremaine LLP; Heather M. Colburn

(57) ABSTRACT

A cover for use with a pouch accessory to a toolbelt. The pouch accessory includes a pouch having a first opening into an interior of the pouch, and at least one sidewall defining the first opening. The first opening is configured to receive a worker's hand. The cover includes a deformable web anchored along its periphery to a frame. The web has a second opening that is smaller than the first opening. The frame is configured to be inserted into the first opening of the pouch. Together, the web and the frame are configured to completely close the first opening with only the second opening providing access to the interior of the pouch when the frame is inserted into the first opening of the pouch.

15 Claims, 5 Drawing Sheets

ATTACHMENT TO A MECHANIC'S TOOLBELT

BACKGROUND OF THE INVENTION

1. Field of the Invention

The present invention is directed generally to toolbelts worn by workers, such as mechanics and construction workers.

2. Description of the Related Art

Conventional toolbelts are commonly worn by workers, such as mechanics and construction workers. Accessories, like pouches, can be attached to or hung from toolbelts. Such accessories may be used to store tools and/or small items, such as nails, screws, and the like. Most pouches have an opening that remains open during use and is large enough for a worker to place his/her hand inside the pouch. As a result, items stored inside a pouch may fall from the pouch as the worker moves around and/or reaches inside the pouch. Therefore, there is a need for devices that prevent items from falling out of a pouch attached to a worker's toolbelt. The present application provides this and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 1:
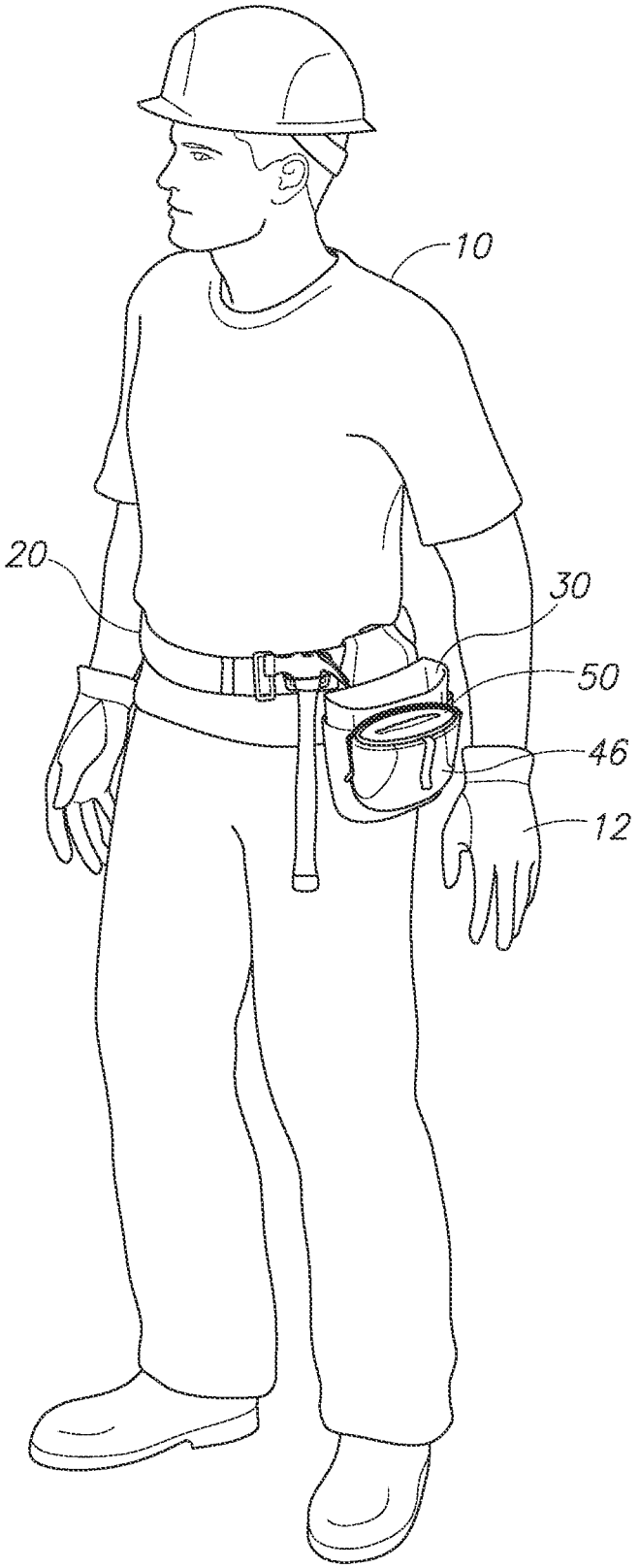
FIG. 1 is a perspective view of a worker wearing a conventional toolbelt and a prior art pouch accessory fitted with an embodiment of a cover assembly constructed in accordance with the present invention.
Figure 2:
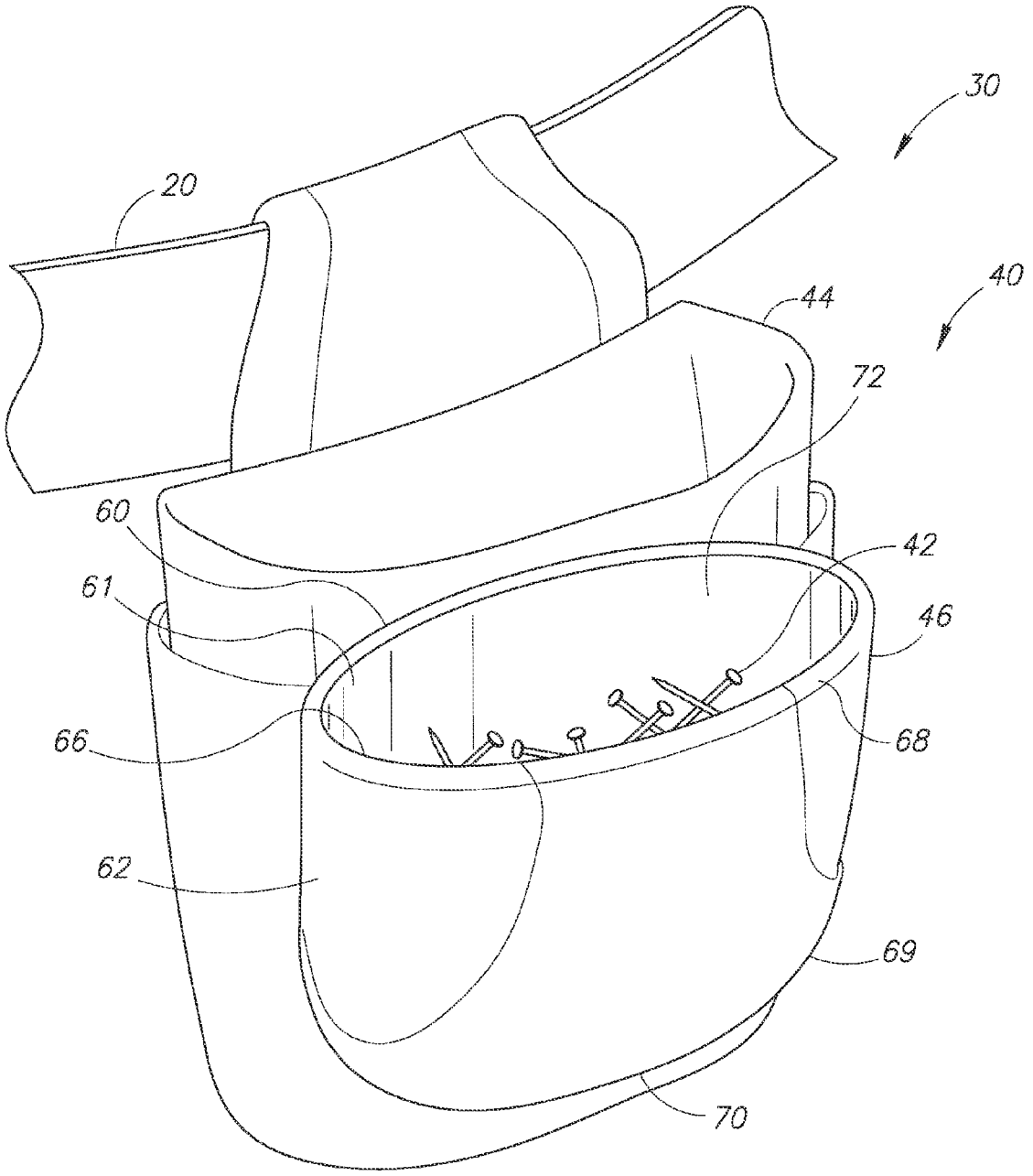
FIG.2 (PRIOR ART)
FIG. 2 is an enlarged perspective view of the prior art pouch accessory of FIG. 1 storing small items.

FIG. 1 depicts a worker 10 wearing a conventional toolbelt 20. A prior art pouch accessory 30 is attached to and hangs from the toolbelt 20. Referring to FIG. 2, in the embodiment illustrated, the pouch accessory 30 includes one or more pouches 40 configured to hold small items 42, such as fasteners, clips, and the like. By way of non-limiting examples, the small items 42 may be nails, screws, bolts, and the like. In the embodiment illustrated, the pouch accessory 30 includes a first pouch 44 adjacent the toolbelt 20, and a second pouch 46 attached to the first pouch 44. However, this is not a requirement.

FIG. 1 also depicts a removable cover assembly 50 that may be used to close one or more of the pouches 40 (see FIG. 2). For ease of illustration, the cover assembly 50 will be described as being used with the second pouch 46. However, this is not a requirement. The second pouch 46 may be implemented as a conventional nail bag or pouch.

Returning to FIG. 2, in the embodiment illustrated, the second pouch 46 has one or more sidewalls 60. The one or more sidewalls 60 have one or more inwardly facing surfaces 61 opposite one or more outwardly facing surfaces 62. The one or more sidewalls 60 have an open upper portion 68 that at least partially define an opening 66 into which the worker 10 (see FIG. 1) may insert a hand 12 (see FIG. 1) to retrieve one or more of the small items 42. In the embodiment illustrated, the opening 66 has a shape that is generally oval. The open upper portion 68 is opposite a lower portion 69 near a closed bottom portion 70 of the second pouch 46. The one or more sidewalls 60 may be constructed from fabric (e.g., woven nylon), leather, and the like. The one or more sidewalls 60 may be flexible, deformable, and the like.

Figure 3:
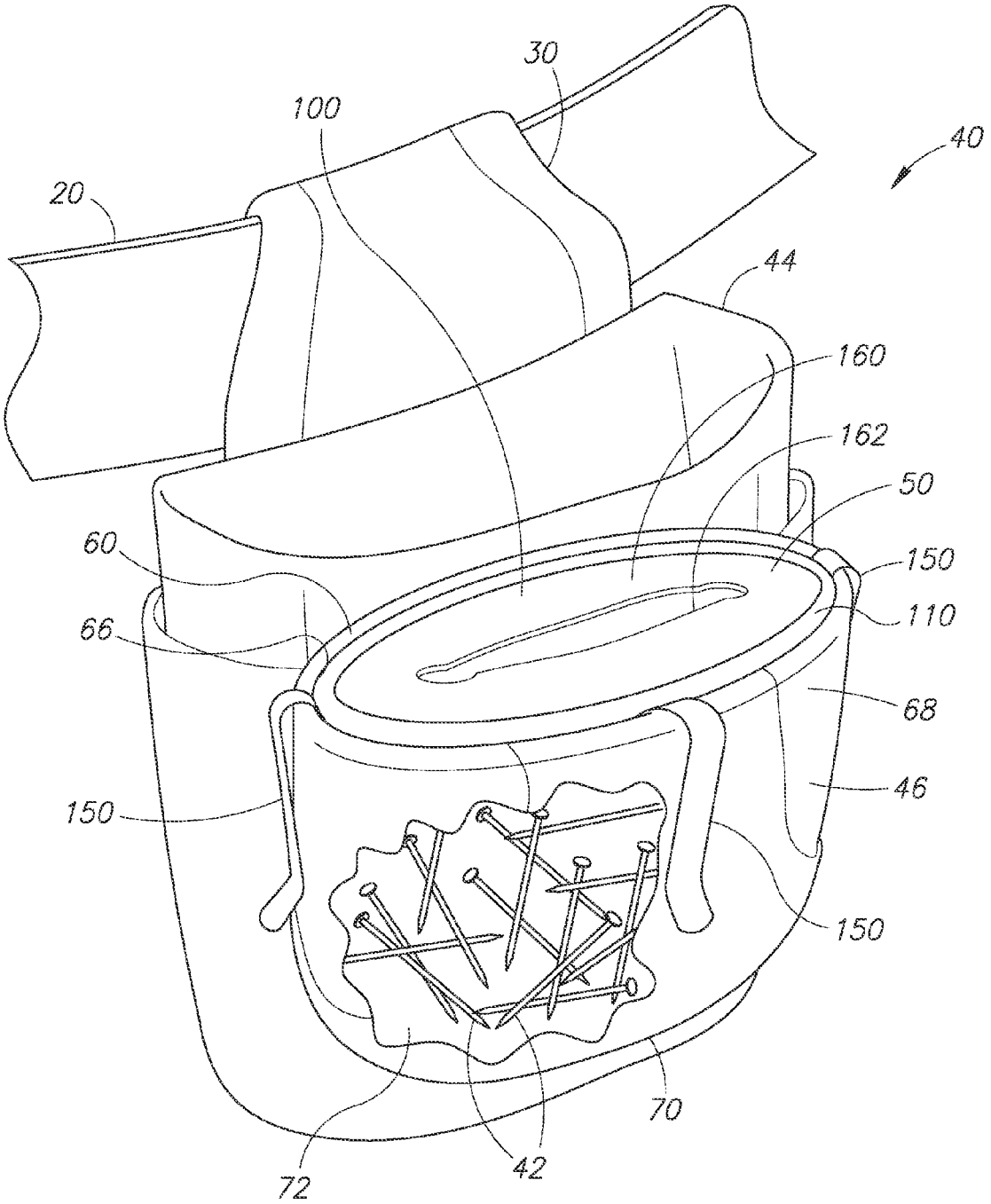
FIG. 3 is an enlarged perspective view of the embodiment of the cover assembly depicted in FIG. 1.

The one or more sidewalls 60 and the closed bottom portion 70 define an interior 72 in which the small items 42 may be stored. Unfortunately, as the worker 10 (see FIG. 1) moves around and/or withdraws the hand 12 (see FIG. 1) from the second pouch 46, some of the items 42 may fall from the opening 66 of the second pouch 46. Referring to FIG. 3, to avoid this problem, the removable cover assembly 50 may be used to partially close or reduce the size of the opening 66 of the second pouch 46.

Figure 4:
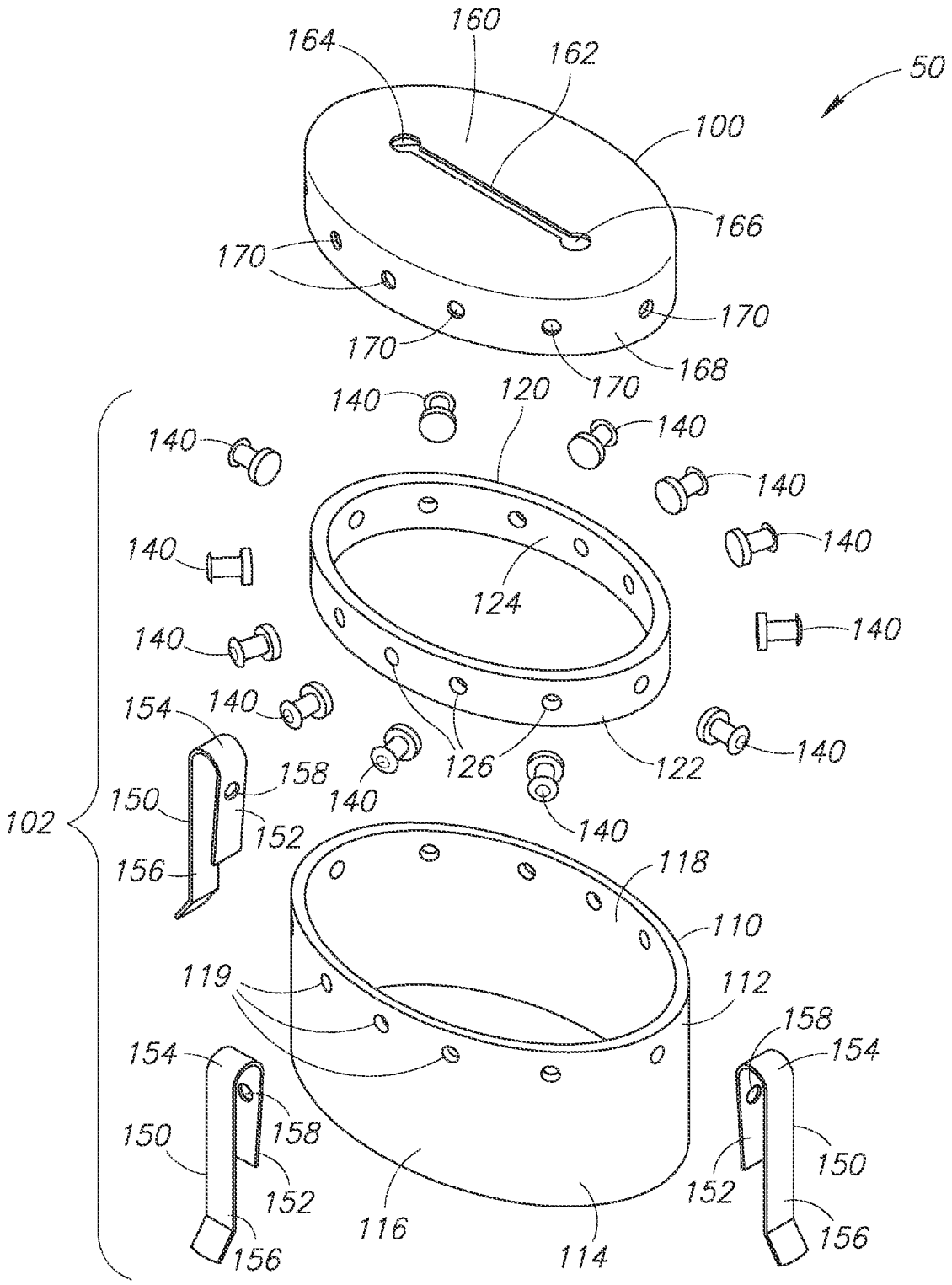
FIG. 4 is an exploded perspective view of the cover assembly of FIG. 3.

FIG. 4 is an exploded perspective view of the cover assembly 50. The cover assembly 50 includes an upper web 100, a frame assembly 102, and optional clips 150. In the embodiment illustrated, the frame assembly 102 includes a body member 110, an anchor member 120, and optional fasteners 140.

The web 100 includes a central portion 160 with an opening or slit 162 configured to allow the hand 12 (see FIG. 5) of the worker 10 (see FIG. 5) to pass therethrough. In the embodiment illustrated, the slit 162 has a first end 164 opposite a second end 166. Optionally, the slit 162 may be larger at its first and second ends 164 and 166. The web 100 has a peripheral portion 168 that surrounds the central portion 160. Optionally, openings 170 may be formed in peripheral portion 168. In FIG. 4, the peripheral portion 168 is illustrated bent downwardly such that the peripheral portion 168 extends downwardly from the central portion 160. However, as is apparent to those of ordinary skill in the art, the web 100 may be formed from a flat piece of material that is bent or folded as illustrated in FIG. 4. The web 100 may be deformable, flexible, stretchable, elastic, and/or pliable. By way of a non-limiting example, the web 100 may be constructed from a sheet of rubber and/or similar materials.

The peripheral portion 168 of the web 100 is coupled to the frame assembly 102, which is configured to be at least partially inserted into the opening 66 (see FIGS. 2 and 3) of the second pouch 46 (see FIGS. 2 and 3). The frame assembly 102 may be substantially cylindrical in shape and sufficiently rigid to press against the opening 66 causing the opening 66 to conform to the outer shape of the frame assembly 102. In the embodiment illustrated, the frame assembly 102 has a substantially oval shaped cross-sectional shape.

As mentioned above, in the embodiment illustrated, the frame assembly 102 includes the body member 110, the anchor member 120, and the optional fasteners 140. The body member 110 is configured to slide into the second pouch 46 (see FIG. 2) and be positioned against the one or more inwardly facing surfaces 61 (see FIG. 2) of the one or more sidewalls 60 (see FIG. 2) of the second pouch 46. Friction between the body member 110 and the one or more sidewalls 60 may help maintain the cover assembly 50 inside the second pouch 46. In the embodiment illustrated, the body member 110 is generally cylindrical in shape. The lateral cross-sectional shape is substantially identical to the shape of the opening 66, which in the embodiment illustrated is generally oval.

The body member 110 has an open upper portion 112 opposite an open lower portion 114. When the body member 110 is inserted into the second pouch 46 (see FIG. 3), the open upper portion 112 is positioned near or adjacent the opening 66 (see FIG. 3), and the open lower portion 114 is positioned deeper inside the interior 72 (see FIG. 3) of the second pouch 46.

The body member 110 has an outwardly facing surface 116 that faces the one or more inwardly facing surfaces 61 (see FIG. 2) of the one or more sidewalls 60 (see FIG. 2). The outwardly facing surface 116 is opposite an inwardly facing surface 118. Optionally, through-holes 119 may extend between the outwardly and inwardly facing surfaces 116 and 118. In the embodiment illustrated, the optional through-holes 119 are formed in the open upper portion 112 of the body member 110.

The body member 110 is rigid or semi-rigid to help maintains its outer shape, which in the example embodiment illustrated is substantially cylindrical. However, the body member 110 may be compressed or deformed by the sidewalls 60 of the second pouch 46 and/or forces applied thereto. By way of a non-limiting example, the body member 110 may be constructed from leather and/or similar materials. For example, the body member 110 may be constructed from a strip of leather curved into a ring or oval shape.

The anchor member 120 may be generally ring-shaped or oval-shaped. While the anchor member 120 is illustrated as being a continuous oval-shaped ring, in alternate embodiments, the anchor member 120 may be discontinuous and include a gap (no shown). In such embodiments, the anchor member 120 may be squeezed or compressed to narrow the gap or stretched to enlarge the gap. Thus, the outer shape of the anchor member 120 may be adjusted to accommodate different pouches, and facilitate assembly of the cover assembly 50. By way of a non-limiting example, the anchor member 120 may be constructed from aluminum and/or similar materials. The anchor member 120 and/or the body member 110 may be constructed from sufficiently wear resistant materials (e.g., pliable plastic) such that when the web 100 wears out, the web 100 may be replaced without also replacing the anchor member 120, the body member 110, and/or the optional fasteners 140. While particular materials have been described as being suitable for constructing the various components of the cover assembly 50, those of ordinary skill in the art appreciate that through application of ordinary skill in the art to the present teachings, alternate materials may be used and the cover assembly 50 is not limited to being constructed from any of the materials described herein.

The anchor member 120 has an outwardly facing surface 122 opposite and inwardly facing surface 124. In the embodiment illustrated, optional through-holes 126 extend between the outwardly and inwardly facing surfaces 122 and 124.

The optional fasteners 140 may include rivets, screws, bolts, nuts, and the like. By way of a non-limiting example, the optional fasteners 140 may be implemented using Chicago screws. In embodiments that do not include the optional fasteners 140, other means of fastening the body member 110, the peripheral portion 168 of the web 100, and the anchor member 120 together, such as adhesives may be used.

The optional clips 150 each have an anchor portion 152 connected by a bent portion 154 to free end portion 156. The anchor portion 152 is configured to be positioned alongside the outwardly facing surface 116 of the body member 110.

In the embodiment illustrated, the optional clips 150 each include a though-hole 158 configured to receive one of the optional fasteners 140. Each of the though-holes 158 may be aligned with a different one of the though-holes 119 formed in the body member 110.

Referring to FIG. 3, each of the optional clips 150 is configured to receive the open upper portion 68 of the one or more sidewalls 60 of the second pouch 46. The optional clips 150 grip at least a portion of the one or more sidewalls 60 and help maintain the cover assembly 50 inside the second pouch 46.

Returning to FIG. 4, to assemble the cover assembly 50, the peripheral portion 168 of the web 100 is wrapped around the outwardly facing surface 122 of the anchor member 120 to form a subassembly. In embodiments that include the openings 170 in the peripheral portion 168 of the web 100 and the through-holes 126 formed in the anchor member 120, the openings 170 are aligned with the through-holes 126. Alternatively, the openings 170 may be formed by the optional fasteners 140.

The subassembly is inserted into the body member 110, and the anchor member 120 is positioned alongside the open upper portion 112 of the body member 110 with the peripheral portion 168 of the web 100 sandwiched between the anchor member 120 and the body member 110. In embodiments that include the through-holes 126 and the through-holes 119 formed in the body member 110, the through-holes 126 are aligned with the through-holes 119. Optionally, at least a portion of the optional fasteners 140 may be used to couple the peripheral portion 168 of the web 100, the anchor member 120, and the body member 110 together.

Next, the optional clips 150 may be positioned adjacent the open upper portion 112 of the body member 110. In embodiments of the body member 110 that include the through-holes 119 and embodiments of the optional clips 150 that each include the though-hole 158, the though-hole 158 of each of the optional clips 150 is aligned with a different one of the through-holes 119. Finally, one of the optional fasteners 140 may be used to couple each of the optional clips 150 to the body member 110, the peripheral portion 168 of the web 100, and the anchor member 120.

Figure 5:
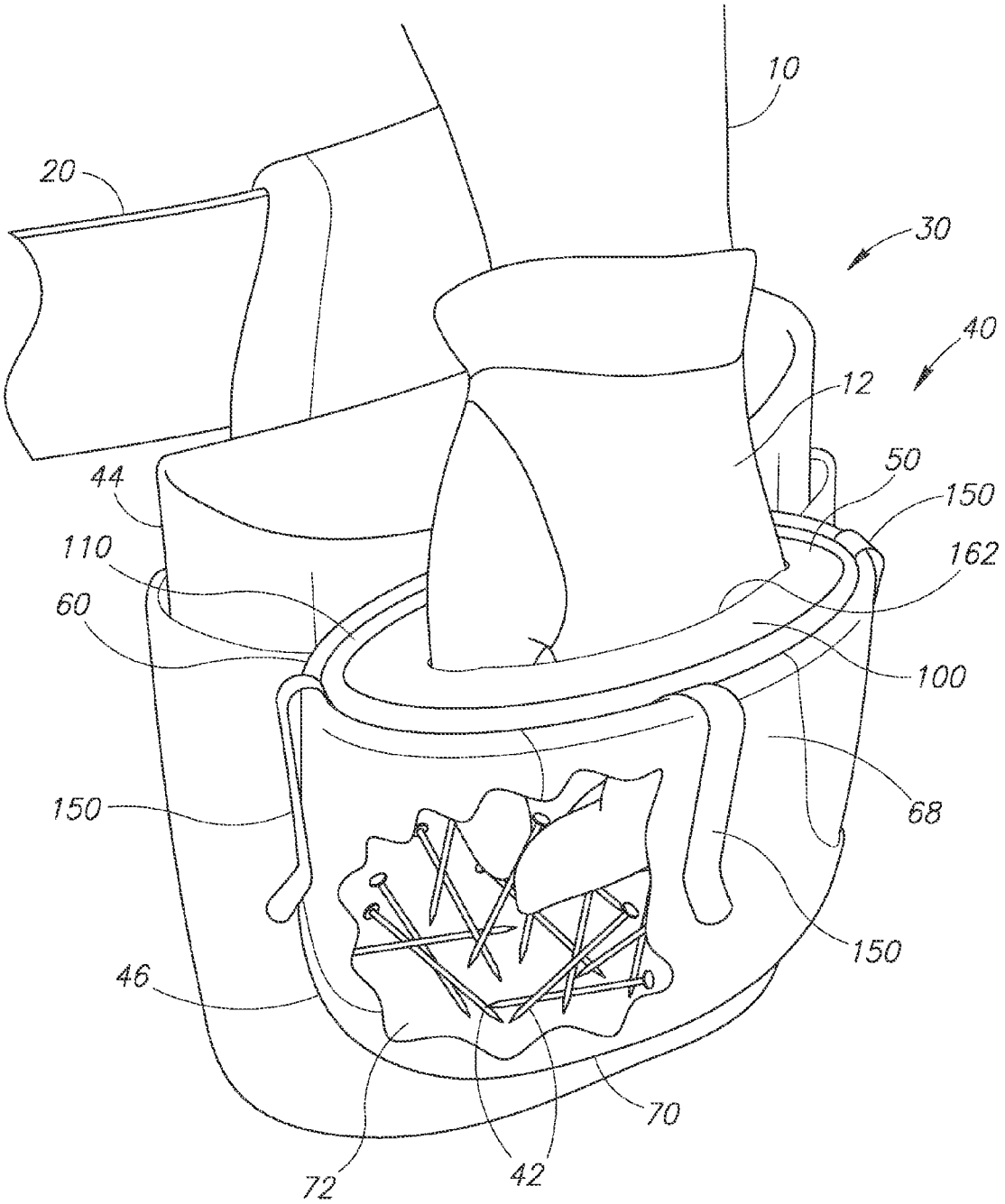
FIG. 5 is a perspective view of a hand of the worker positioned inside a slit of the cover assembly and grasping a small item stored inside a pouch of the pouch accessory.

After the cover assembly 50 is assembled, the cover assembly 50 may be coupled to the second pouch 46 as illustrated in FIGS. 3 and 5. Referring to FIG. 3, this may be achieved by inserting the open lower portion 114 (see FIG. 4) of the body member 110 into the opening 66 of the second pouch 46 until the open upper portion 68 of the one or more sidewalls 60 of the second pouch 46 are gripped by the optional clips 150. The web 100 and/or the frame assembly 102 (see FIG. 4) at least partially close the opening 66 such that the interior 72 of the second pouch 46 is accessible only through the slit 162 formed in the web 100. The slit 162 may be positioned near or adjacent the opening 66 of the second pouch 46. In the embodiment illustrated, the slit 162 is approximately centered inside the opening 66.

The small items 42 may be placed inside the second pouch 46 before the cover assembly 50 is coupled to the second pouch 46. Alternatively, the small items 42 may be placed inside the second pouch 46 though the slit 162. As shown in FIG. 5, the worker 10 may retrieve the small items 42 from the second pouch 46 by inserting the hand 12 into the second pouch 46 through the slit 162.

The cover assembly 50 may be removed from the second pouch 46 by gripping the cover assembly 50 and lifting it out of the second pouch 46. This will disengage the optional clips 150 from the one or more sidewalls 60.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A system comprising:

a toolbelt;

a pouch accessory configured to be worn on the toolbelt, the pouch accessory comprising a pouch having an interior, an opening into the interior, and at least one sidewall defining the opening, the opening being configured to receive a worker's hand; and a cover comprising a web and a frame, the web comprising a slit and a peripheral portion, the frame comprising a body member and an anchor member, the body member being configured to be at least partially insertable into the opening of the interior of the pouch, the anchor member being configured to be positioned alongside the body member with the peripheral portion of the web positioned between the body member and the anchor member, the body member, the peripheral portion of the web, and the anchor member being coupled together, the body member extending along the at least one sidewall of the pouch when the body member is at least partially inserted into the opening, the web at least partially closing the opening when the body member is at least partially inserted into the opening with the slit being positioned adjacent the opening and permitting the worker's hand to pass therethrough to access the interior of the pouch.

2. The system of claim 1, wherein the cover further comprises:

at least one clip configured to grip the at least one sidewall of the pouch when the body member is at least partially inserted into the opening of the interior of the pouch.

3. The system of claim 1, wherein when the body member is at least partially inserted into the opening of the interior of the pouch, friction between the body member and the at least one sidewall of the pouch helps maintain the body member inside the interior of the pouch.

4. The system of claim 1, wherein the cover further comprises:

a plurality of fasteners coupling the body member, the peripheral portion of the web, and the anchor member together.

5. The system of claim 1, wherein the body member and the anchor member are each annularly shaped.

6. A system comprising:

a pouch configured to be worn on a toolbelt, the pouch comprising a sidewall defining a first opening into an interior of the pouch, a cover comprising a deformable web anchored along its periphery to a frame configured to be inserted into the first opening of the pouch, the web comprising a second opening that is smaller than the first opening, the frame comprising a body member and an anchor member, the body member being configured to be inserted into the first opening of the interior of the pouch, the anchor member being configured to be positioned alongside the body member with the periphery of the web positioned between the body member and the anchor member, the body member, the periphery of the web, and the anchor member being coupled together, the web and the frame together completely closing the first opening with only the second opening providing access to the interior of the pouch when the body member is inserted into the first opening of the pouch.

7. The system of claim 6, wherein the cover further comprises:

at least one clip configured to grip the pouch when the body member is inserted into the first opening of the pouch.

8. The system of claim 6, wherein when the body member is inserted into the first opening of the interior of the pouch, friction between the body member and the pouch helps maintain the body member inside the interior of the pouch.

9. The system of claim 6, wherein the cover further comprises:

a plurality of fasteners coupling the body member, the periphery of the web, and the anchor member together.

10. The system of claim 6, wherein the body member and the anchor member are each annularly shaped.

11. A system comprising:

a pouch configured to be worn on a toolbelt, the pouch having an opening with a first shape into an interior of the pouch; and a selectively removable and reusable cover comprising a generally cylindrical frame and a web, the web comprising a peripheral portion and an aperture, the frame having a second lateral cross-sectional shape, the second lateral cross-sectional shape being substantially identical to the first shape, the frame comprising a body member and an anchor member, the body member comprising a first open end opposite a second open end, the second open end of the body member being configured to be inserted into the opening of the pouch, the anchor member being configured to be positioned alongside the first open end of the body member with the periphery of the web positioned between the first open end the body member and the anchor member, the first open end of the body member, the periphery of the web, and the anchor member being coupled together, the body member being insertable into the opening with the first open end positioned near the opening in the pouch, the web covering the first open end of the body member, the interior of the pouch being accessible through the aperture.

12. The system of claim 11, wherein the body member is substantially rigid and presses on at least a portion of the opening to thereby press the opening into the first shape.

13. The system of claim 11, wherein the cover further comprises:

at least one clip configured to grip the pouch when the second open end of the body member is inserted into the opening of the pouch.

14. The system of claim 11, wherein when the second open end of the body member is inserted into the opening of the interior of the pouch, friction between the body member and the pouch helps maintain the body member inside the interior of the pouch.

15. The system of claim 11, wherein the first shape and the second lateral cross-sectional shape are both oval.

* * * * *